United States Patent [19]

Bruno

[11] 4,242,823

[45] Jan. 6, 1981

[54] MAGNETICALLY ATTRACTIVE DISPLAY DEVICE

[76] Inventor: John Bruno, 77-83 Second Ave., Patterson, N.J. 07524

[21] Appl. No.: 829,149

[22] Filed: Aug. 30, 1977

[51] Int. Cl.[3] ..... G09F 7/04

[52] U.S. Cl. ..... 40/621; 40/124

[58] Field of Search ..... 40/600, 621, 154, 158; 248/206 A; 335/303, 285

[56] References Cited

U.S. PATENT DOCUMENTS

| | | | |
|---|---|---|---|
| 1,168,949 | 1/1916 | McKittrick et al. | 40/621 |
| 1,395,982 | 11/1921 | Gee | 40/621 |
| 1,433,850 | 10/1922 | Schnitker | 40/621 X |
| 1,624,741 | 4/1927 | Leppke et al. | 40/621 |
| 2,575,470 | 11/1951 | Salz | 40/154 X |
| 2,668,370 | 2/1954 | Trimble | 40/621 |
| 2,785,490 | 3/1957 | Fabry | 40/621 X |
| 2,921,388 | 1/1960 | Stefaney | 335/285 X |
| 3,168,787 | 2/1965 | Surrey | 40/600 |
| 3,186,118 | 6/1965 | Smith | 40/154 |
| 3,228,133 | 1/1966 | Baermann | 40/621 |
| 3,381,864 | 5/1968 | Shields | 248/206 A X |
| 3,383,785 | 5/1968 | Werner | 40/621 X |
| 3,464,134 | 9/1969 | Franklin | 40/621 |
| 3,651,592 | 3/1972 | McCormick | 40/621 X |
| 3,716,935 | 2/1973 | Friederichs | 40/621 |
| 4,101,884 | 7/1978 | Benton | 40/621 |

FOREIGN PATENT DOCUMENTS

| | | | |
|---|---|---|---|
| 842480 | 7/1960 | United Kingdom | 40/621 |

*Primary Examiner*—Gene Mancene

*Assistant Examiner*—Wenceslao J. Contreras

*Attorney, Agent, or Firm*—Morgan, Finnegan, Pine, Foley & Lee

[57] ABSTRACT

A lightweight magnetically attractive display device includes a relatively thin sheet-like intermediate layer which is adapted to be magnetically attractive at spaced intervals and which is supported in a generally planar configuration, and an outer face sheet adapted to be attached to the device in front of and adjacent the intermediate layer so that magnetized indicia characters can be removably attached to the device, against the outer layer, by the magnetic attraction between the intermediate layer and the magnetic portions on the indicia characters. As preferably embodied, the intermediate layer comprises a lightweight mesh screen made of magnetically attractive material. Alternatively, the intermediate layer may comprise a plurality of closely spaced magnetically attractive strands or a sheet of lightweight material having magnetically attractive particles dispersed therein. Advantageously, the outer face sheet is generally translucent to enable light to pass therethrough for highlighting the message formed by the indicia characters, which are preferably opaque. Also advantageously, two intermediate layers may be supported from a frame, with two translucent outer face sheets attached to the frame adjacent each of the intermediate layers, and an illumination source can be positioned within the space between the two intermediate layers for illuminating the messages attached to the two sides of the device.

10 Claims, 10 Drawing Figures

MAGNETICALLY ATTRACTIVE DISPLAY DEVICE

BACKGROUND AND OBJECTS OF THE INVENTION

The present invention relates generally to signs, display devices and the like, and, more particularly, to lightweight display devices adapted to retain magnetized display indicia.

Various devices abound in the prior art for advertising or displaying various messages. In general, most devices are designed for rather specific purposes and are, therefore, usually of fixed construction, even in applications wherein the message is to be displayed temporarily. Thus, for example, in advertising special prices or sales in grocery stores, shopping centers and the like, advertisements are printed on sheets of white paper which are usually taped to the inside surface of large windows. In this way, the costs for the advertising materials can be kept relatively low. In addition, and of particular significance, since the paper is usually generally translucent, it can be easily read during the day as a result of the sunlight incident on its outwardly-facing surface and during the night as a result of the transmittal, through the translucent paper, of some of the illumination from interior store lights which are usually left at least partially illuminated for security reasons.

Although the paper signs have provided adequate advertising for window displays and the like, they suffer several drawbacks. In general, the signs require advance printing time so that saleworthy changes in merchandise, pricing or inventory cannot be instantaneously advertised. In addition, it may be possible for competitors to obtain advance notice of the special price or sale and adjust their pricing or other policy in an effort to emasculate some of the advantage to be derived by the advertised sale. Moreover, once the signs have served their purpose, they are never re-used, but are simply discarded.

Although re-usable display devices such as the slotted board signs have been developed, which are adapted to retain letters by tabs formed on the backs thereof, they are not conveniently suited to replace the paper signs. The devices are significantly heavy and, therefore, unsuitable for providing a hanging display, particularly in windows. In addition, they are not adapted to be translucent, which further reduces their desirability for window displays. In addition, if the tabs on the letters break, the letters are rendered useless.

In addition, although magnetic display devices are appealing because of the ease with which messages can be changed, they too are unsuitable for replacing the paper signs. They are made from either a plate or a sheet of magnetically attractive material and are, therefore, about as heavy and expensive as the slotted sign boards. Moreover, such plates or sheets are obviously incapable of being translucent. Thus, heretofore, there has not been developed a lightweight and inexpensive re-usable display device which utilizes magnetic attraction between the device and the magnetic portions on display characters, and which is suitable for displaying messages in windows and the like.

Accordingly, it is an object of the present invention to provide a new and improved display device. It is another object of the present invention to provide a new and improved re-usable display device which is substantially lightweight and inexpensive.

It is also an object of the present invention to provide a new and improved lightweight re-usable display device which utilizes magnetic attraction between the display characters and the display support member and which is strong and attractive.

It is a further object of the present invention to provide a new and improved magnetic display device which can be adapted to provide a generally translucent background against which display indicia can be supported for display thereof.

It is an additional object of the present invention to provide a new and improved display device which is adapted to permit essentially instantaneous display of any desired message.

It is still another object of the present invention to provide a new and improved display device which enables the displayed message to be illuminated from two or more display surfaces while also enabling the use magnetized indicia characters for forming the messages to be displayed.

Objects and advantages of the invention are set forth in part herein and in part will become apparent herefrom, or may be appreciated by practicing the invention, the same being realized and attained by means of the instrumentalities, combinations and devices pointed out in the appended claims. Accordingly, the present invention resides in the novel parts, constructions, arrangements and improvements herein shown and described.

SUMMARY OF THE INVENTION

Briefly described, the lightweight display device according to the present invention includes a relatively thin, sheet-like member, or layer, which is adapted to be magnetically attractive at spaced intervals, and support means associated with the intermediate layer for maintaining the intermediate layer flat and generally rigid. Advantageously, the device includes a thin outer sheet adapted to be attached in front of the magnetically attractive member so that magnetized indicia characters can be removably attached to the device, against the cover sheet, by the magnetic attraction between the magnetically attractive member and the magnetized indicia characters. Also advantageously, the outer sheet is generally translucent, and a generally translucent backing sheet may be secured to the frame behind the screen.

As preferably embodied, the intermediate layer comprises a screen made of magnetically attractive material and the support means is a frame adapted to grasp the edges of the screen. Alternatively, the magnetically attractive member may comprise closely spaced parallel strands of magnetically attractive material suspended from opposite sides of the frame, or a sheet of material having particles of magnetically attractive material embedded, or dispersed therein, with the material advantageously being translucent.

According to still a further embodiment of the invention, the frame may comprise a pair of correspondingly formed frame members made of stiffened paper or the like, between which is sandwiched the sheet of magnetically attractive material along with the outer sheet and the backing sheet, if one or both of the latter are used.

In addition, a backing sheet of stiffened material can be attached to one side of the magnetically attractive sheet to support the latter in a flat configuration, and the outer sheet may be attached to the other side of the magnetically attractive sheet.

According to another aspect of the invention, two such magnetically attractive sheets may be supported from a frame, spaced from each other, with an outer sheet adapted to be positioned in front of each screen sheet. In addition, illumination means may be positioned between the two corresponding pairs of sheets.

It will be found that the objects and advantages specifically enumerated herein are achieved by the invention as herein disclosed. Accordingly, it will be found that a display device is provided, which is substantially lightweight yet enables the use of magnetic indicia characters. It will also be found that by providing a screen mesh or wire strand layer or a translucent sheet with magnetically attractive particles dispersed therein, and a translucent outer sheet, the display device according to the present invention is substantially entirely translucent for ready viewability by sunlight reflected from the front of the device or artificial light transmitted through the layers from behind the device, yet it enables the use of magnetized indicia characters.

It will further be found that by providing a frame adapted to support two spaced corresponding pairs of magnetically attractive sheets and translucent sheets according to the invention, a light may be retained in position in the space between the two assemblies to illuminate the messages formed thereon.

Also, it will be found that by providing a display device with a substantially lightweight substrate which is magnetically attractive at spaced intervals, the message(s) displayed thereon can be changed virtually instantly to reflect any change in merchandise, pricing, etc.

In addition, by providing a frame made of stiffened paper or the like for surrounding the magnetically attractive sheet, and the outer and backing sheets if used, it will be found that a substantially inexpensive magnetically attractive display device can be made, which may be translucent and which can be formed in numerous desired configurations.

Additionally, it will be found that by attaching a stiffened backing sheet to the magnetically attractive sheet, the display device may be made opaque while still being substantially lightweight. In addition, a frame element made of stiffened material could be attached to the other side of the magnetically attractive member with the outer sheet sandwiched therebetween for a substantially lightweight display device which is still aesthetically appealing.

Moreover, by providing a frame with means for permitting removable attachment of the outer layer, it will be found that various outer display sheets bearing different fixed message portions may be quickly and easily attached to the frame for conpletely changing the display.

It will be understood that the foregoing general description as well as the following detailed description are exemplary and explanatory of the invention, but are not restrictive thereof. To this end, the accompanying drawings referred to herein and constituting a part hereof, illustrate preferred embodiments of the invention and, together with the description, serve to explain the principles of the invention.

DETAILED DESCRIPTION OF PREFERRED EMBODIMENTS

Figure 1:
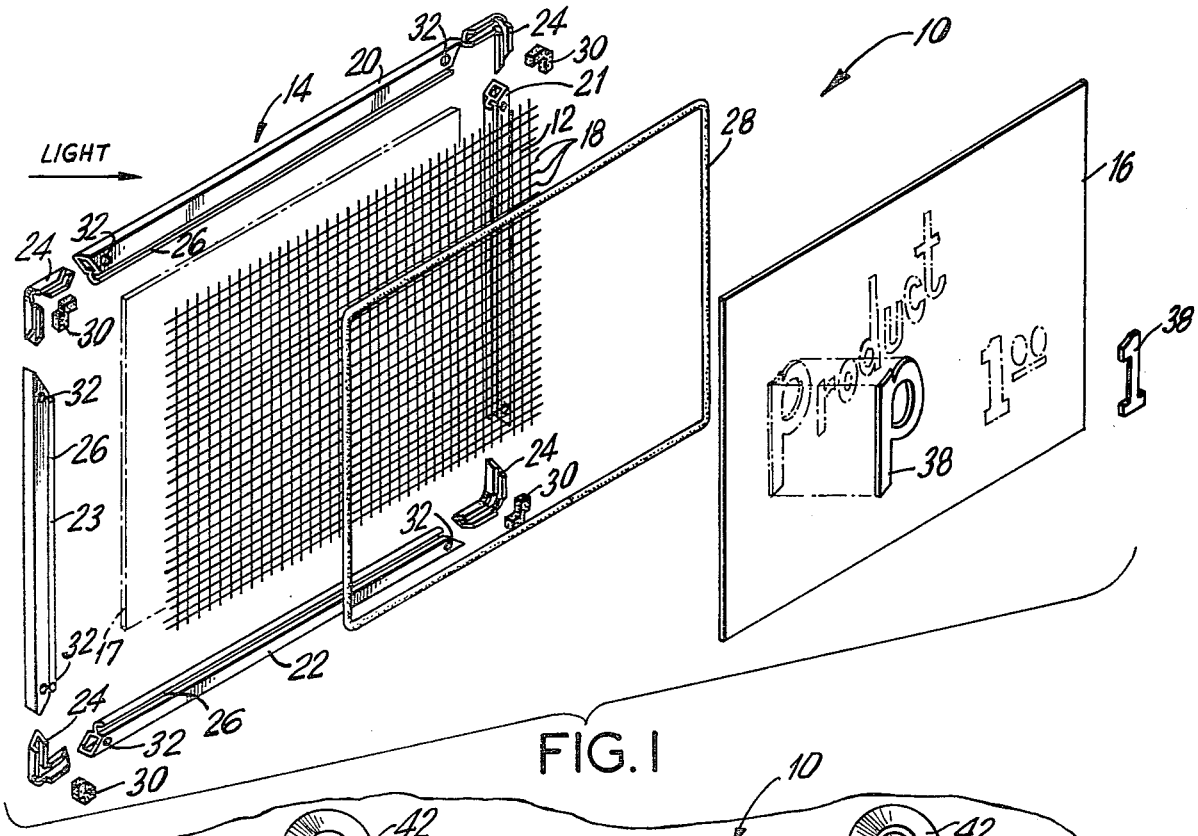
FIG. 1 is an exploded view of a display device constructed in accordance with the present invention.
Figure 2:
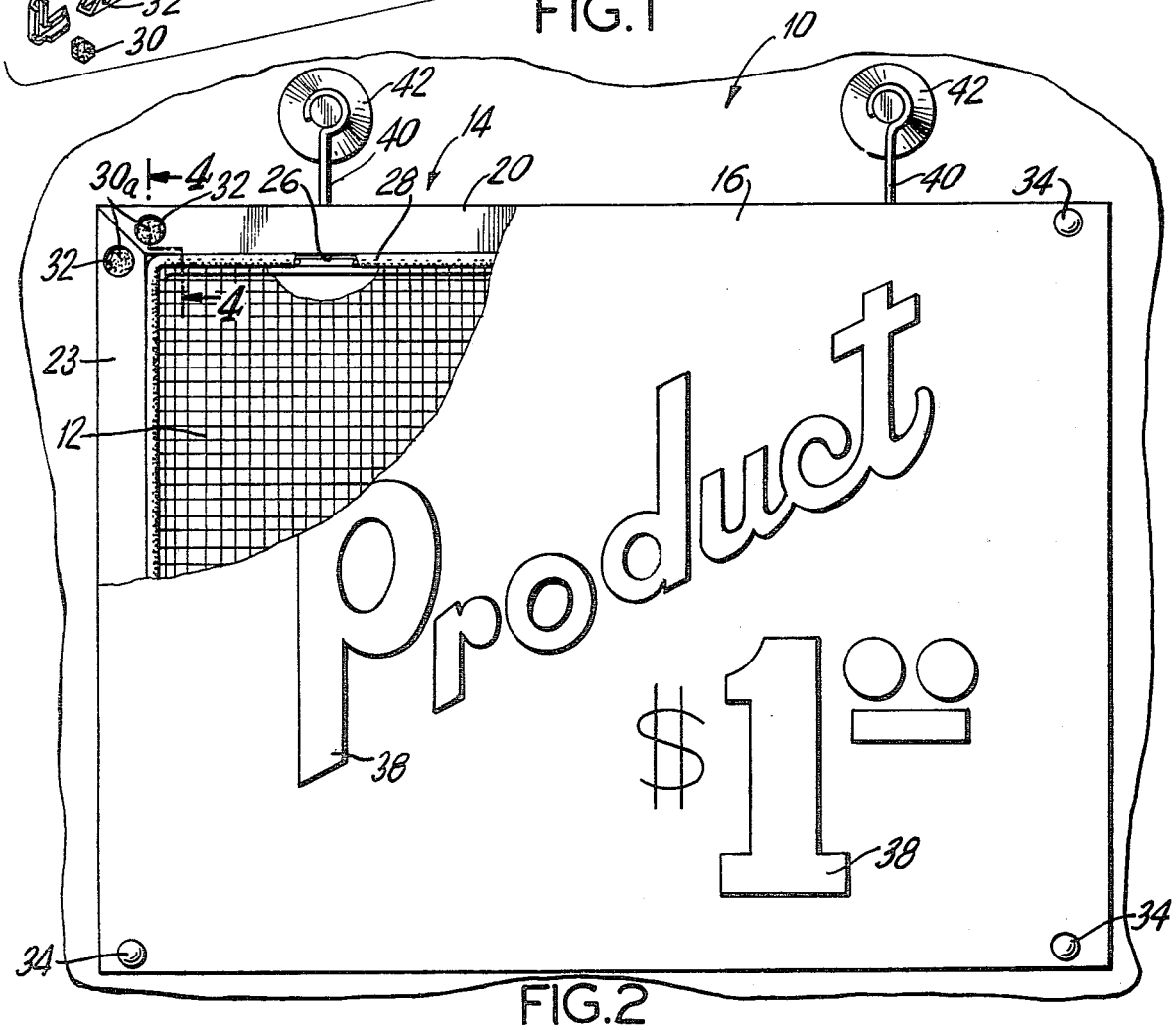
FIG. 2 is an elevation view, with partial cut-away, of the assembled device shown in FIG. 1.
Figure 3:
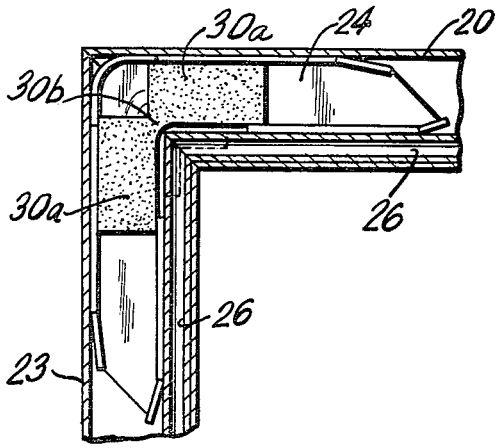
FIG. 3 is a section view of a corner of the device shown in FIG. 1.
Figure 4:
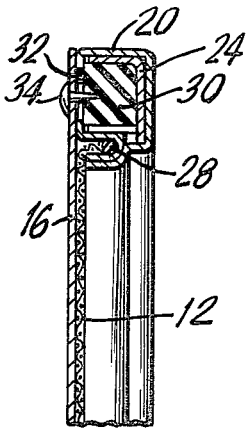
FIG. 4 is a section view taken along section 4—4 of FIG. 2.

Referring now generally to the drawings wherein like reference characters refer to like parts, throughout the various views, there is illustrated in FIGS. 1–4, a preferred embodiment of a display device, indicated generally by reference number 10, constructed in accordance with the present invention. Display device 10 includes a sheet-like intermediate member, or layer 12 which is adapted to be magnetically attractive at spaced intervals (as described more fully hereinafter) and which is retained in a generally flat configuration by support means, here in the form of frame means indicated generally by reference numeral 14. Advantageously, and as here embodied, display device 10 also includes outer face, or cover, sheet 16 adapted to be attached to frame 14, in contact with or closely adjacent magnetically attractive layer 12.

As preferably embodied, layer 12 is made of a wire mesh screen comprising a plurality of cross-hatched wire strands (each indicated at 18). Advantageously, strands 18 are made of galvanized steel and/or are painted to withstand rusting. However, it will be understood that strands 18 may be made of any magnetically attractive material. In addition, it will be understood that by painting the strands, the overall aesthetic appearance of the device may be enhanced, particularly if painted the same color as cover sheet 16. However, if painting is impractical or undesirable, a backing sheet 17 (indicated in phantom is FIG. 1) may be secured to the device adjacent the back surface of screen 12, so that intermediate layer 12 is sandwiched between cover sheet 16 and backing sheet 17.

Figure 5:
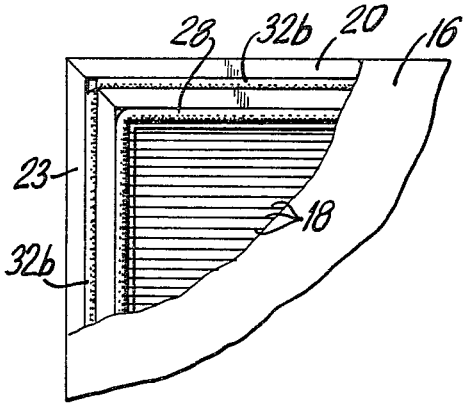
FIG. 5 is a partial elevation view, with partial cut-away, of a corner of an alternate construction of the structure shown in FIG. 1.
Figure 6:
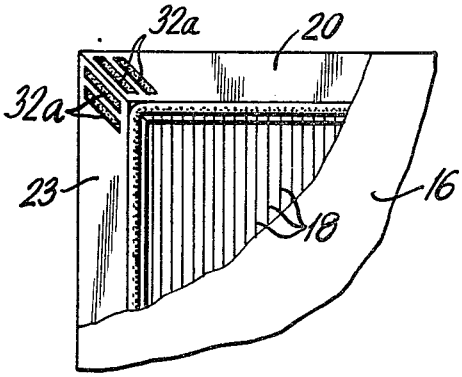
FIG. 6 is a partial elevation view, with partial cut-away, of a corner of another alternate construction of the structure shown in FIG. 1.

Accordingly, since screen mesh sheets possess inherent strength and rigidity, magnetically attractive layer 12 can be simply and easily affixed to frame 14 for maintaining the desired configuration thereof, as will be described more fully hereinafter. However, it will be understood that layer 12 could be formed simply by securing a plurality of closely spaced parallel magnetically attractive strands 18 to frame 14, as illustrated in FIGS. 5 and 6. In this way, layer 12 will be approximately half as heavy as the screen mesh, but may require a stronger frame 14 or either a stronger magnet on the indicia characters (if the characters are simply provided with one or two separate magnets attached to their back surfaces) or larger surface-area indicia characters (if they are made from plastic sheets having a magnetized backing).

Referring again to FIG. 1, frame means 14 is made up of four side members, indicated at 20, 21, 22 and 23 (members 20 and 21 being opposite members 22 and 23, respectively), which may be aluminum roll formed sections, such as used on insect screens, because of their strength, lightness and attractiveness. Frame members 20–23 are retained in assembled form by L-shaped corner pieces 24, and, advantageously, each side member is formed with a channel-like recess (indicated at 26), preferably positioned on each member to form a continuous recess in the front surface of the assembled frame. The continuous recess is adapted to retain the edges of the screen mesh layer 12 by a resilient gasket-like spline 28 which is wedged into recess 26 to provide a force-fit closure. It will be understood, of course, that where only unidirectional strands 18 (as shown in FIGS. 5 and 6) are utilized for magnetically attractive layer 12, the ends of strands 18 can be similarly retained in the recesses 26 formed on oppositely disposed frame members (i.e., members 20 and 22 or members 21 and 23).

Also advantageously, corner angle members 24 are generally channel-like in cross-section with the opening thereof positioned to face the front, or viewing side, of display device 10. In addition, inserts 30 are located within the channels of corner members 24 and, the front surfaces of the side members (20-23) near each corner of frame means 14 are formed with openings (indicated at 32) therethrough, which are adapted to expose a portion of each insert 30. As preferably embodied, inserts 30 are made of a generally resilient material, such as neoprene, or other rubber which can withstand repeated puncturing by tacks (indicated at 34) or the like, and retain the tacks so that outer face sheet 16 can be attached to frame 14 adjacent layer 12.

Also advantageously, in order to accommodate frames with other than 90°-corners, inserts 30 may be formed by a pair of insert members, each indicated at **30*a*, held together preferably by an integral flexible hinge 30*b*. Alternatively, inserts 30 may be formed either as diagonally extending strips 32*a* formed separately on each side member at the ends thereof (as shown in FIG. 6) or by providing an elongate strip 32*b* in each side member, extending generally the entire length thereof (as shown in FIG. 5**).

Thus, a plurality of outer display sheets 16 can be prepared for attachment at different times to the device, each sheet having a different message and/or being finished in different colors for providing the desired displaying effect when installed. In addition, and of particular significance, magnetic indicia characters (indicated at 38) can be removably attached to device 10 and retained against the front of sheet 16 to provide any desired message. As preferably embodied, for compactness and easy display in, for example, a window, each character 38 is formed from a flat magnetic plastic sheet, such as KOROSEAL magnetic sheet, made by the B. F. Goodrich Co., while display sheet 16 can be made of a relatively thin sheet of material such as paper or, preferably for durability, a thin sheet of vinyl or other flexible plastic material, such as Taffeta vinatex vinyl sold by Apex Plastic Industries, Hauppauge N.Y. However, it will be understood that where thickness of the indicia characters is not of concern, characters can be used, which are each formed with separate magnet elements attached to the back thereof. It will also be understood that where permanent, rather than removable, attachment of sheet 16 to frame 14 is desired, the edges of sheet 16 can be retained in recesses 26 along with intermediate layer 12 (as well as backing sheet 17, if used) by spline means 28, substantially as described above.

When the display device is assembled, with outer face sheet 16 attached to the front of frame 14, characters 38 can be removably attached to device 10 by the magnetic attraction between the magnetic portions on characters 38 and the magnetically attractive material in layer 12 to secure the desired message to the device. Alternatively, sheet 16 can be permanently provided with a partial message as well as one or more blank portions wherein indicia characters 38 can be positioned to complete the message. Therefore, several sheets 16 can be provided, all of the same size and each with a different partial message for advertising various special offers which may re-occur with some degree of frequency. Thus, for example, sheet 16 may be permanently printed with a partial message such as "Special this week: Leg of Lamb _¢ per pound" so that the blank can be filled by placing the appropriate magnetic indicia characters 38 in the blank space to indicate the price. In either event, display device 10 may be placed in desired prominent display location, such as behind a window, and retained there, as by hanging from support members 40 which are attached to frame 14 and to which are attached suction cups 42 for attachment directly to the window. However, where display device 10 is to be attached to a wall, hung from a ceiling, etc., suction cups 42 may be omitted and support members 40 may be suitably formed to effect such installation.

It will be understood by those skilled in the art that by using a screen mesh intermediate layer (or parallel strands 18), light from inside a store can pass through the numerous spaces in layer 12, substantially undiminished, and, thereafter, through outer sheet 16 to highlight the message magnetically attached on the device when the interior lighting intensity exceeds that on the exterior. To this end, a screen mesh having strands separated to form spaces of about ⅛ inch square has been found particularly useful for providing sufficient surface area to enable sufficient magnetic attraction for retaining the letters (despite the presence of outer layer 16 therebetween) while providing ample void areas to permit the transmission of light.

As preferably embodied, there must be a certain minimum amount of magnetically attractive material for a given area (whether by the spacing between adjacent strands of magnetically attractive material or the density of dispersion of particles within a sheet-like medium) in order to be sufficiently magnetically attractive for retaining magnetized characters on the device despite the presence of outer layer 16. Thus, for example, with an outer layer 16 of Taffeta vinatex vinyl at between 0.003"–0.006" (preferably less than 0.005") thick and characters made of magnetized KOROSEAL strip material at about 0.02" thick, a screen mesh having spacings of about ⅛ inch between adjacent strands will provide sufficient density for the magnetically attractive material.

Figure 7:
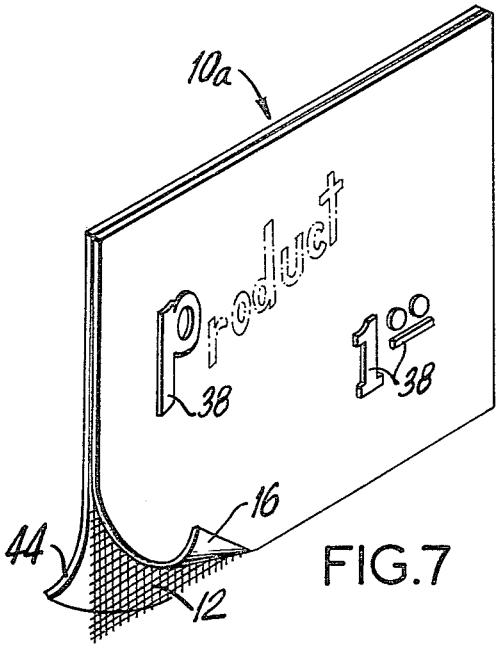
FIG. 7 is a perspective view of another display device constructed according to the present invention.

Turning now to FIG. 7, there is shown an embodiment of a display device (indicated at **10*a*) which illustrates another aspect of the present invention. According to this aspect, layer 12, preferably a sheet of wire mesh screen (for rigidity), is sandwiched between outer sheet 16 and a thin sheet 44 made of somewhat rigid material such as stiffened paper, cardboard or the like or a sheet of thin plastic. Thus, due to the combined rigidity of layer 12 and sheet 44, frame means 14 may be omitted. However, for aesthetic appearance, it is preferred that frame means 14 be included on the device since it will still be substantially lightweight. In addition, display device 10***a* is particularly useful for displaying messages where translucency is not desired or for displaying messages on both sides of the device, by providing opaque sheet 44 so that light will not be transmitted through the device to interfere with reading the two messages. However, for displaying messages on both sides of device 10*a*, sheet 44 will also be proportioned thin enough to enable characters 38 to be attached to the device by the magnetic attraction between layer 12 and the characters, despite the presence of sheet 44.

Figure 8:
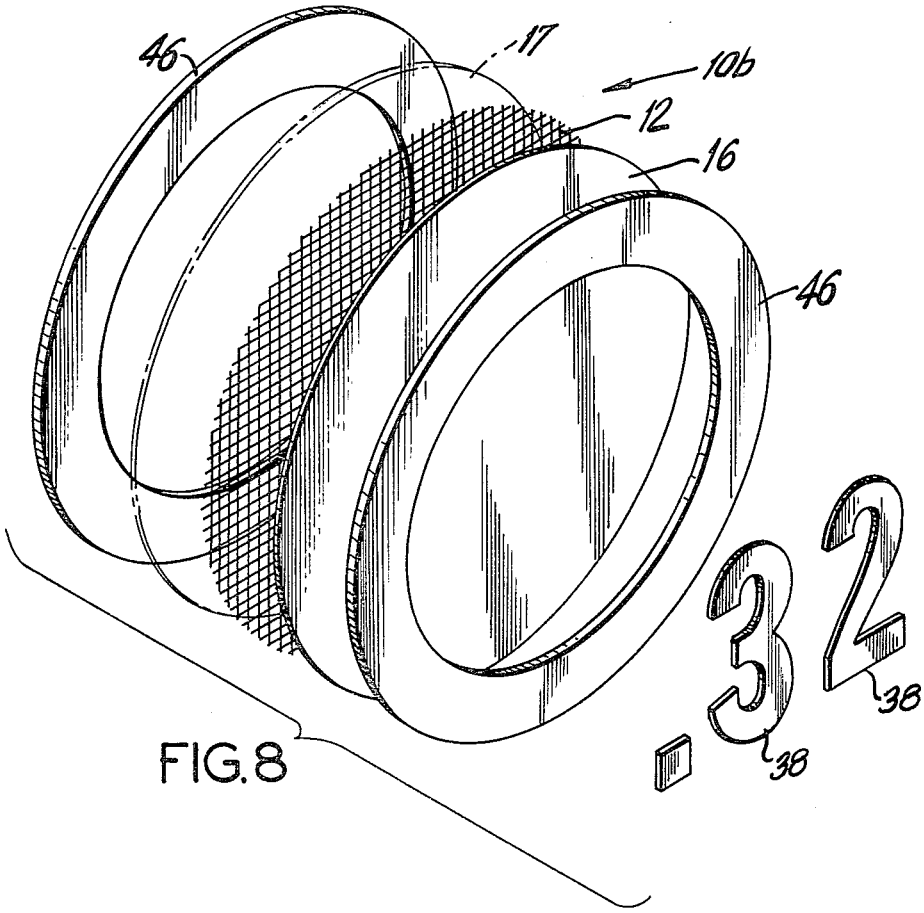
FIG. 8 is an exploded view of another display device constructed in accordance with the present invention.

Turning now to FIG. 8, there is shown another alternate embodiment of a display device (indicated at 10*b*), which is constructed in accordance with the present invention and which is particularly useful as a relatively inexpensive display device. According to this embodiment, frame means 14 may be formed simply from two cardboard, or stiffened paper, members 46 which are sandwiched about the combination of display sheet 16 and intermediate layer 12 and, if used, backing sheet 17. A display device such as illustrated in FIG. 8 may, for example, be attached to a large poster or taped directly to a window to indicate such brief information as a sale price. Alternatively, a large poster can be formed from two half-thickness sheets which are formed with correspondingly proportioned and positioned cut-outs so that when the two half-sheets are bonded together, display sheet 16 and intermediate layer 12, and, if used, backing sheet 17, can be sandwiched and retained therebetween. Thus, the poster will be provided with an integrally formed magnetically attractive display portion to which any desired magnetic display indicia can be releasably attached.

Figure 10:
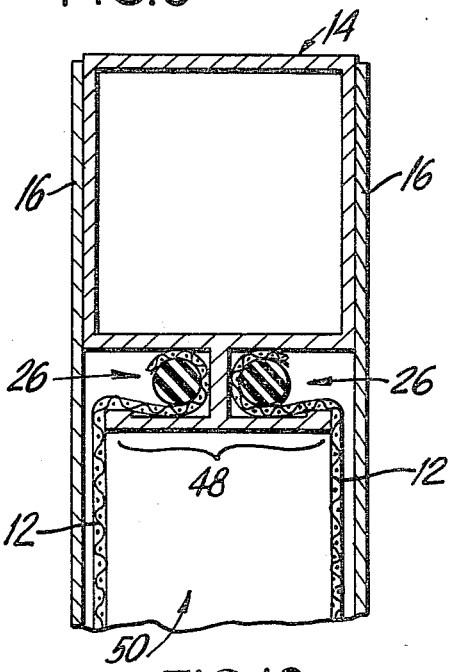
FIG. 10 is a sectional view of a portion of a modified embodiment of the device shown in FIG. 9.
Figure 9:
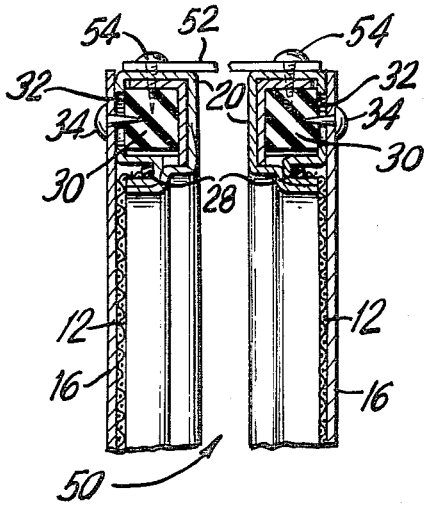
FIG. 9 is a sectional view of a portion of still another display device constructed in accordance with the present invention.

Turning now to FIGS. 9–10, there are shown portions of another embodiment of a display device which is constructed in accordance with another aspect of the present invention. According to this aspect of the invention, the display device is adapted to enable illumination of a display message on two or more sides, by an artificial light source. As shown more particularly in FIG. 9, two frame members identical to that illustrated in FIG. 4 may be attached facing back-to-back to plate 52 (shown here as broken, for convenience) which is fastened to both frame members 20 by threaded fasteners 54, thereby defining space 50 accommodate illumination means (not shown) so that light can be transmitted through each layer 12 and each sheet 16 (preferably translucent), which are attached to the frames 14.

Turning now to FIG. 10, there is shown a modified embodiment of the device shown in FIG. 9. As shown in FIG. 10, the side members of frame means 14 are formed with two continuous channel-like recesses 26 which open to oppositely facing sides of the device. Thus, two mesh screen sheets 12 can be attached to opposite sides of frame means 14, as by splines 28 force fit in recesses 26, essentially as described above with reference to FIGS. 1–4, leaving space 50 therebetween for accommodating the illumination means (not shown). As preferably embodied, flange portion 48 is proportioned to form part of each channel-like recess 26 and to provide sufficient space between the two intermediate layers 12 for accommodating the illumination means. In addition, each sheet 16 may be attached to the frame of the display device of FIG. 9 or 10 either by tacks 34 piercing inserts 30, 32*a* or 32*b*, or by force fit within recesses 26 by splines 28, as described more fully with references to FIGS. 1–4.

Accordingly, when display device 10*b* is assembled together, magnetic indicia characters 38 may be removably attached to the device, as described above, on both sides thereof. The light in space 50 will, therefore, illuminate both display sheets 16 to emphasize the message contained thereon.

Those skilled in the art will recognize that changes or modifications may be made in the embodiments described above, without departing from the scope and spirit of the invention as defined in the appended claims. Thus, for example, intermediate layer 12 can be formed of a generally continuous lightweight medium such as a thin sheet of plexiglas with particles of metal or other magnetically attractive material dispersed therein. In addition, frame means 14 can be adapted to form a box-like structure, with four display surfaces and a light positioned interior thereof for providing a display which is viewable from four directions. Moreover, sheet 44 may be a sheet of stiffened paper or cardboard adhered to screen 12 to which is adhered outer sheet 16, with one correspondingly proportioned stiffened paper frame member similar to 46 bonded to the other side of outer sheet 16. Furthermore, magnetically attractive layer 12 may itself be provided with sufficient rigidity to maintain a flat configuration, as by using a stiff screen or a generally rigid material in which the magnetically attractive particles are dispersed. Also, outer sheet 16 may, when desired, be generally transparent.

Accordingly, the invention in its broader aspects is not limited to the specific embodiment herein shown and described, but variations may be made therefrom within the scope of the accompanying claims, without departing from the principles of the invention and without sacrificing its principal advantages.

What is claimed is:

1. A lightweight display device for supporting magnetized indicia characters, which comprises:

a generally sheet-like first member being magnetically attractive at spaced intervals, said first member comprising a woven mesh screen of strands of magnetically attractive material, said woven mesh screen being formed from two sets of closely spaced parallel strands of said material, which sets extend essentially perpendicular to each other;

a frame member adapted to maintain the strands of said woven mesh screen in a generally planar configuration;

a substantially lightweight generally sheet-like second member adapted to provide at least a background for said magnetized indicia characters, said second member being held in a generally flat configuration adjacent said first member by said frame member and said second member being sufficiently flexible to be held directly against said first member between said magnetized indicia characters and said first member without requiring additional fastener means; and a generally lightweight, sheet-like backing member attached to said device adjacent said first member on the opposite side thereof from said second member, such that magnetized indicia characters may be removably attached in desired positions against said second member by magnetic attraction between said first member and the magnetized indicia characters and said second member is held adjacent said first member only by said frame member and the magnetic attraction between said indicia characters and said first member.

2. A display device according to claim 1 wherein said outer member is generally translucent.

3. A display device accorrding to claim 2 wherein adjacent strands of said screen are spaced about 150 inch apart.

4. A display device according to claim 1 wherein both said second member and said backing member are generally translucent.

5. A display device according to claim 1, wherein said second member and said backing member are made of essentially the same material such that said indicia characters can be attached to both sides of said display device.

6. A display device according to claim 5, wherein said second member and said backing member are essentially opaque.

7. A lightweight display device for supporting megnetized indicia characters, which comprises:

a generally sheet-like first member being magnetically attractive at spaced intervals;

frame means for maintaining said first member in a generally flat configuration;

a substantially lightweight generally sheet-like second member adapted to provide at least a background for said magnetized indicia characters, said second member being held in a generally flat configuration adjacent said first member by said frame means, and said second member being sufficiently flexible to be held directly against said first member between said magnetized indicia characters and said first member without requiring additional fastener means; and a generally lightweight sheet-like backing member attached to said device by said frame means adjacent said first member on the opposite side of said first member from said second member, such that magnetized indicia characters may be removably attached in desired positions against said second layer by magnetic attraction between said first member and the magnetized indicia characters and said second member is held adjacent said first member only by said frame means and the magnetic attraction between said indicia characters and said first member.

8. A display device according to claim 7, wherein said second member and said backing member are made of essentially the same material such that said indicia characters can be attached to both sides of said display device.

9. A display device according to claim 8, wherein said second member and said backing member are essentially opaque.

10. A lightweight display device for supporting magnetized indicia characters, which comprises:

a generally sheet-like first member being magnetically attractive at spaced intervals, said first member comprising a screen made from a plurality of relatively closely spaced parallel strands of magnetically attractive material;

a frame member adapted to maintain said strands in a generally planar configuration, said frame comprising a pair of correspondingly proportioned frame elements bonded together with said strands sandwiched therebetween, said frame elements being made from stiffened paper, cardboard or the like;

a substantially lightweight generally sheet-like second member adapted to provide at least a background for said magnetized indicia characters, said second member being held in a generally flat configuration adjacent said first member between said frame elements, and said second member being sufficiently flexible to be held directly against said first member between said magnetized indicia characters and said first member without requiring additional fastener means, such that magnetized indicia characters may be removably attached in desired positions against said second layer by magnetic attraction between said first member and the magnetized indicia characters and said second member is held adjacent said first member only by said frame member and the magnetic attraction between said indicia characters and said first member.

* * * * *